US012366089B2

(12) United States Patent
Sheperson

(10) Patent No.: US 12,366,089 B2
(45) Date of Patent: Jul. 22, 2025

(54) POST DRIVER

(71) Applicant: John Lee Sheperson, Gravel Switch, KY (US)

(72) Inventor: John Lee Sheperson, Gravel Switch, KY (US)

( * ) Notice: Subject to any disclaimer, the term of this patent is extended or adjusted under 35 U.S.C. 154(b) by 0 days.

(21) Appl. No.: 18/453,616

(22) Filed: Aug. 22, 2023

(65) Prior Publication Data

US 2024/0060329 A1 Feb. 22, 2024

Related U.S. Application Data

(60) Provisional application No. 63/399,984, filed on Aug. 22, 2022.

(51) Int. Cl.
*E04H 17/26* (2006.01)

(52) U.S. Cl.
CPC ..... *E04H 17/263* (2013.01)

(58) Field of Classification Search
CPC ..... E04H 17/263
See application file for complete search history.

(56) References Cited

U.S. PATENT DOCUMENTS

| | | | | |
|---|---|---|---|---|
| 2,998,087 | A * | 8/1961 | Iddings | E02D 7/04 173/133 |
| 3,313,356 | A * | 4/1967 | Clevenger | E04H 17/263 144/195.5 |
| 3,747,690 | A * | 7/1973 | Deike | E02D 3/046 173/121 |
| 5,097,912 | A * | 3/1992 | Bowers | E04H 12/2269 173/90 |
| 2009/0090527 | A1* | 4/2009 | Wilson | E04H 17/263 173/90 |

* cited by examiner

*Primary Examiner* — Nathaniel C Chukwurah
(74) *Attorney, Agent, or Firm* — Indiana University Maurer School of Law

(57) ABSTRACT

A post driver includes a post receptacle, a pair of handles, a pair of springs, and a plug. The post receptacle is configured to receive a post. The springs are configured to apply a substantially constant force as the post driver is raised or lowered relative to the post.

15 Claims, 9 Drawing Sheets

POST DRIVER

RELATED APPLICATIONS

The present application claims the benefit of U.S. Provisional Application No. 63/399,984, filed Aug. 22, 2022 to John Lee Sheperson; the entire disclosure of which is expressly incorporated by reference herein.

TECHNICAL FIELD

The present disclosure is directed to a post driver for driving fence posts or otherwise similar items into the ground.

BACKGROUND AND SUMMARY OF THE DISCLOSURE

The following statements are intended to facilitate an understanding of the present disclosure. The statements are to be read in this light and should not be construed as admissions of prior art.

Post drivers are mechanical tools used to drive posts, such as fence posts, rods, sticks, or other similar items, collectively "posts" into the ground. Common post drivers require a user to repeatedly raise and lower the post driver to drive the posts into the ground. Operation of a post driver in this manner can be exhausting.

According to the present disclosure, a post driver is provided that comprises a post receptacle having an interior sized to receive a post, at least one handle supported by the post receptacle, a plug positioned in the post receptacle to drive a post received by the post receptacle, and at least one substantially constant force spring coupled to the plug to apply a substantially constant force to the plug.

According to another aspect of the present disclosure, a post driver is provided that comprises a post receptacle having an interior sized to receive a post, at least one handle supported by the post receptacle, a plug positioned in the post receptacle to drive a post received by the post receptacle, and at least one spring coupled between the post receptacle and plug to apply a force to the plug, the at least one spring being positioned outside of the interior of the post receptacle.

According to another aspect of the present disclosure, a method of driving a post is provided. This method comprises the steps of providing a post driver and a post, driving the post with the post driver into the ground, and applying a substantially constant upward force to the post driver as the post driver is raised relative to the post.

Additional features of the present disclosure will become apparent to those skilled in the art upon consideration of the following detailed description of the illustrative embodiment exemplifying the best mode of carrying out the disclosure as presently perceived.

BRIEF DESCRIPTION OF THE DRAWINGS

The detailed description of the drawings particularly refers to the accompanying figures in which.

Figure 1:
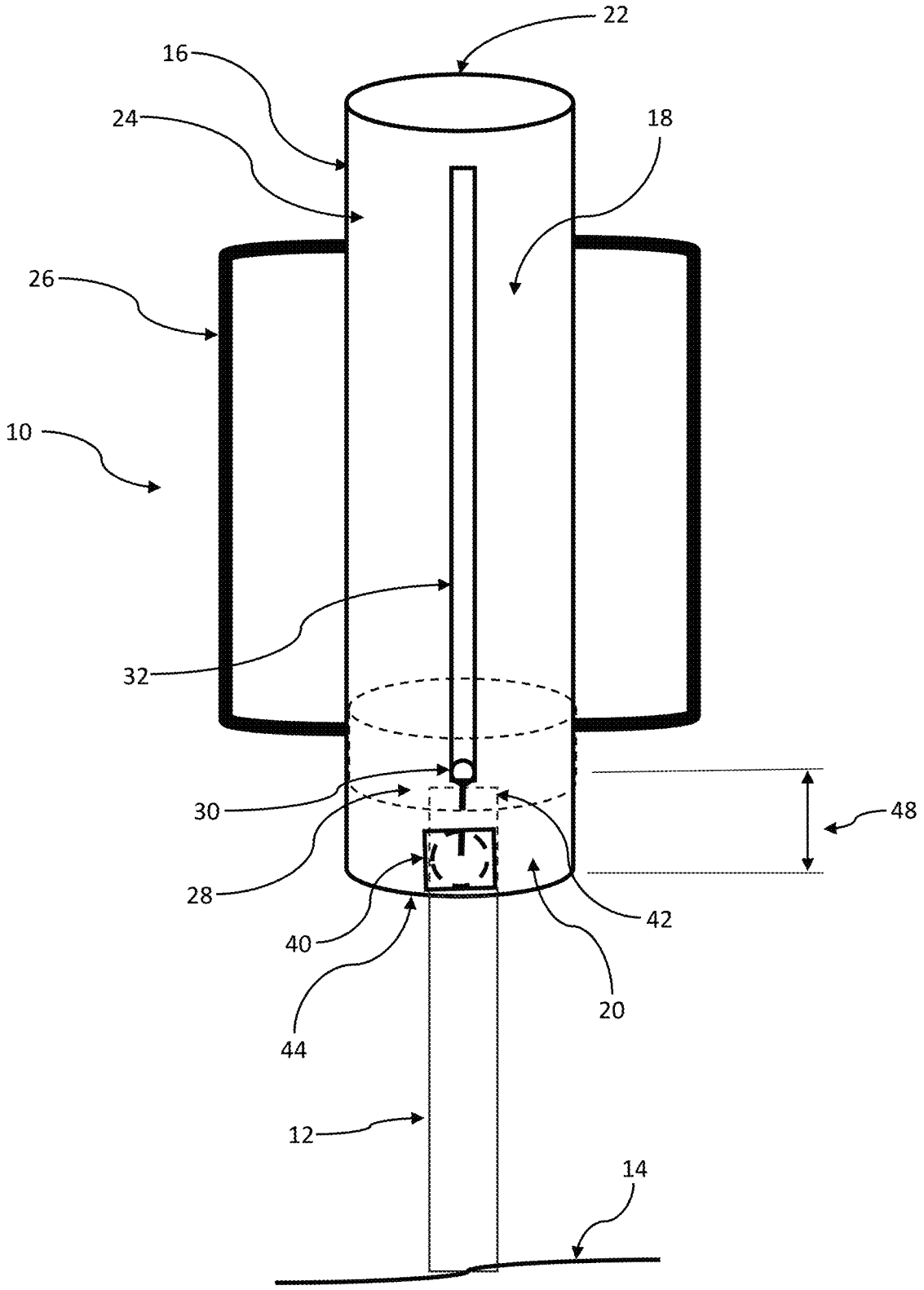
FIG. 1 is a front view of a post driver raised to receive a post showing the post driver including a pair of substantially unwound and retracted springs (one visible) and a plug (in phantom) in a lower position to contact the post.

For the purpose of promoting an understanding of the principals of the disclosure, reference will now be made to the embodiments illustrated in the drawings, which are described below. The embodiments disclosed below are not intended to be exhaustive or limit the disclosure to the precise form disclosed in the following detailed description. Rather, the embodiments are chosen and described so that others skilled in the art may utilize their teachings. Unless otherwise indicated or apparent, the components shown in the figures are proportional to each other. It will be understood that no limitation of the scope of the disclosure is thereby intended. The disclosure includes any alterations and further modifications in the illustrative devices and described methods and further applications of the principles of the disclosure, which would normally occur to one skilled in the art to which the disclosure relates.

DETAILED DESCRIPTION OF THE DRAWINGS

As shown in FIG. 1, a post driver 10 is provided to drive a post 12 into ground 14. Post driver 10 includes a post receptacle 16 having an interior 18 sized to receive post 12. Post receptacle 16 is shown as a hollow cylinder having an open lower end 20 and a closed top end 22 and a cylindrical body 24 extending between open lower end 20 and closed top end 22. Post driver 10 also includes a pair of handles 26 coupled to cylindrical body 24. During use, a user raises and lowers post driver 10 by grasping handles 26.

Post driver 10 also includes a plug 28 positioned in interior 18. Plug 28 is preferably solid and cylinder-shaped, having an outside diameter smaller than an inside diameter of cylindrical body 24. During raising and lowering of post driver 10, plug 28 moves relative to cylindrical body 24 after making contact with post 12. Post driver 10 also includes a pair of lugs 30 coupled to plug 28. Cylindrical body 24 of post receptacle 16 includes a pair of slots 32. Lugs 30 are positioned in respective slots 32. Handles 26 may be rotated 90 degrees to align with slots 32 or otherwise be rotated on cylindrical body 24.

According to an alternative embodiment, the body of the post receptacle is square, formed by two pieces of angle iron that are welded or otherwise coupled together. Slots are provided on opposite corners of the square, hollow body to receive lugs 30 as described herein. The slots may be cut into the corners or the pieces of angle iron may be separated by a spacer at the upper and lower ends, creating a gap between the pieces of angle iron that form the slots. The spacers are then welded to the pieces of angle iron. A plate may be welded to an upper end of the angle iron pieces to form a closed top end.

Figure 2:
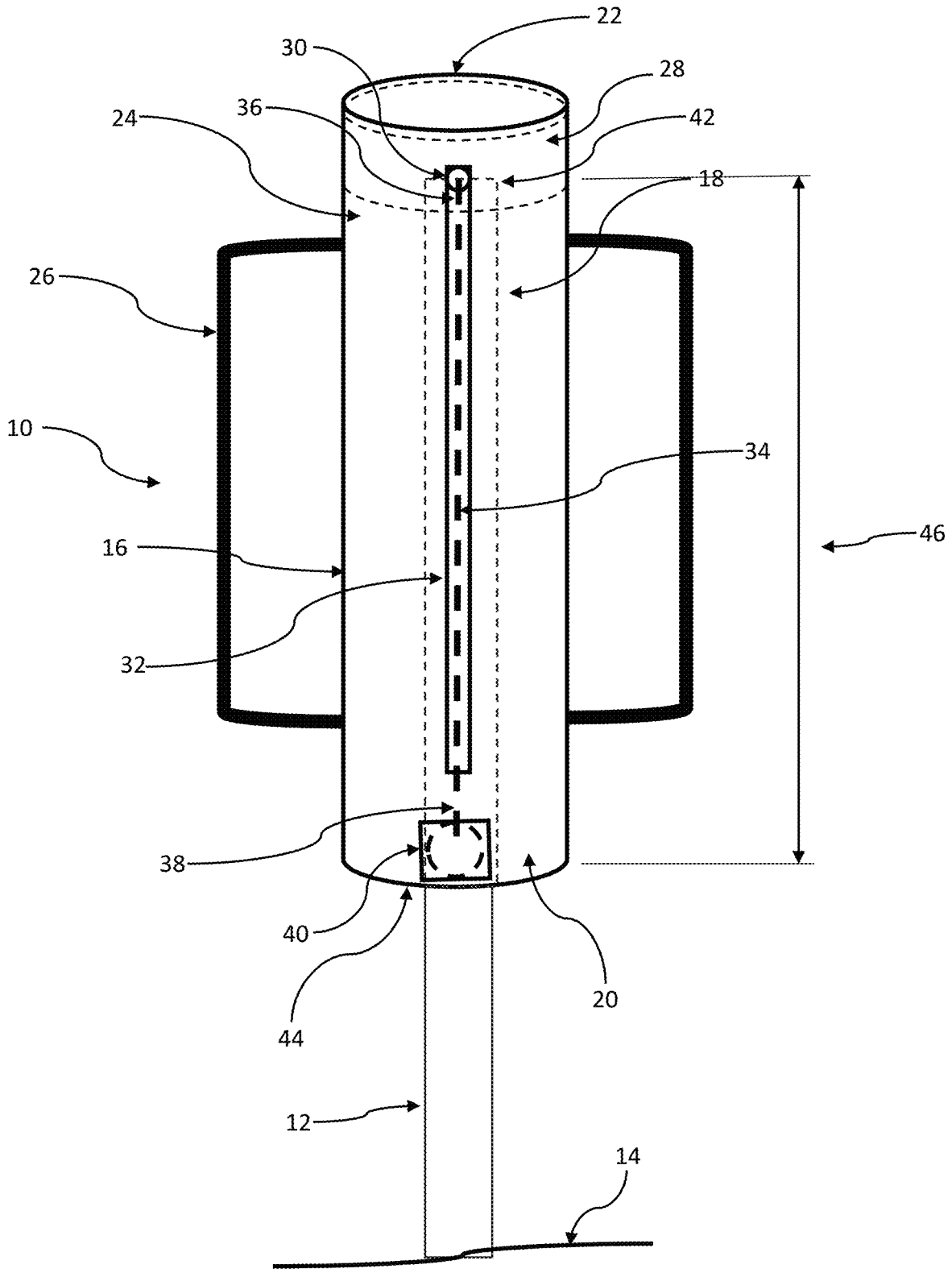
FIG. 2 is view similar to FIG. 1 with the post driver lowered to drive the post showing the springs (one visible) substantially wound and extended and the plug is a raised position driving the post into the ground.
Figure 3:
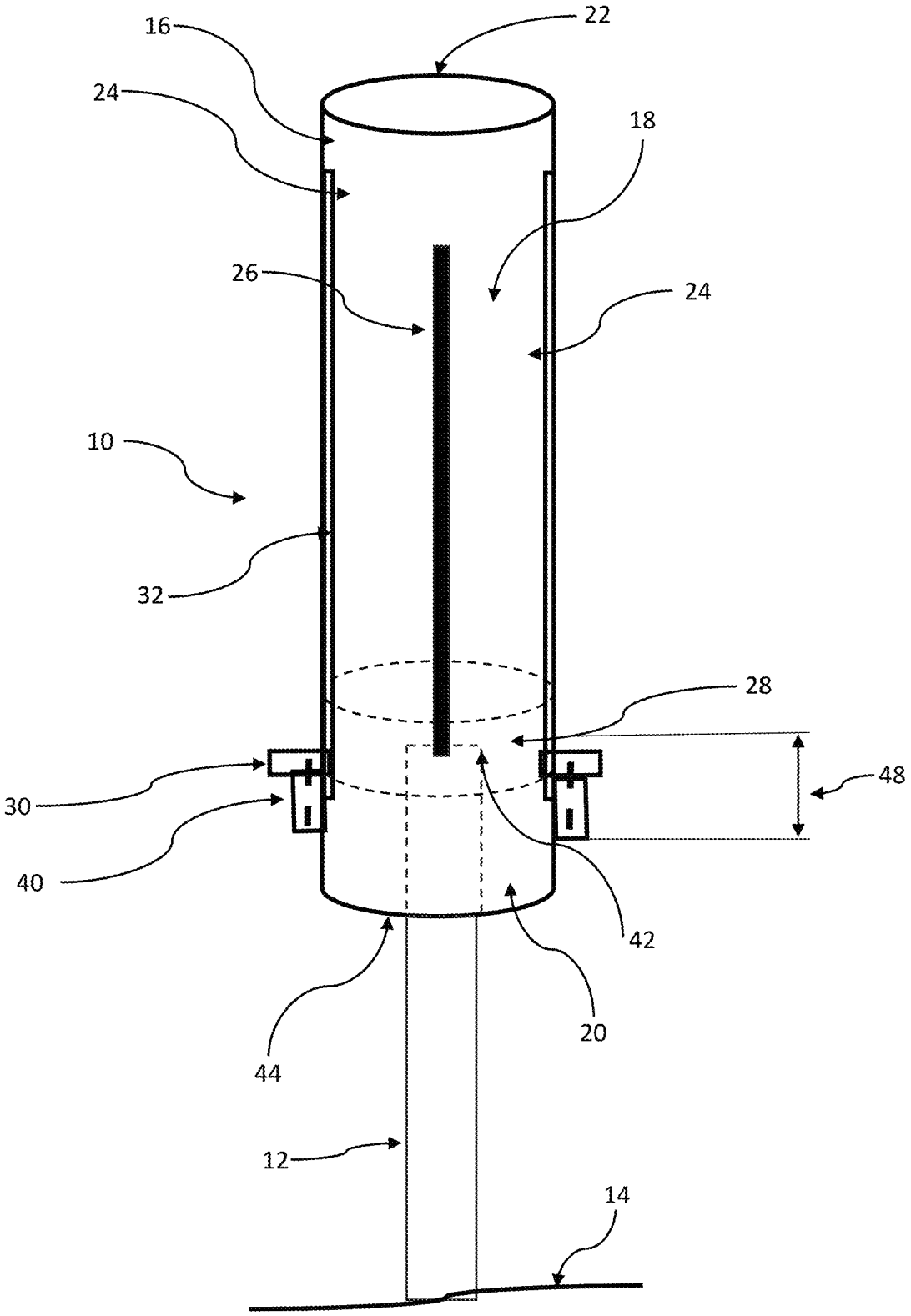
FIG. 3 is a side view of the raised post driver of FIG. 1 showing lugs extending through slots in a cylindrical body of post driver coupling the plug to the retracted springs.
Figure 4:
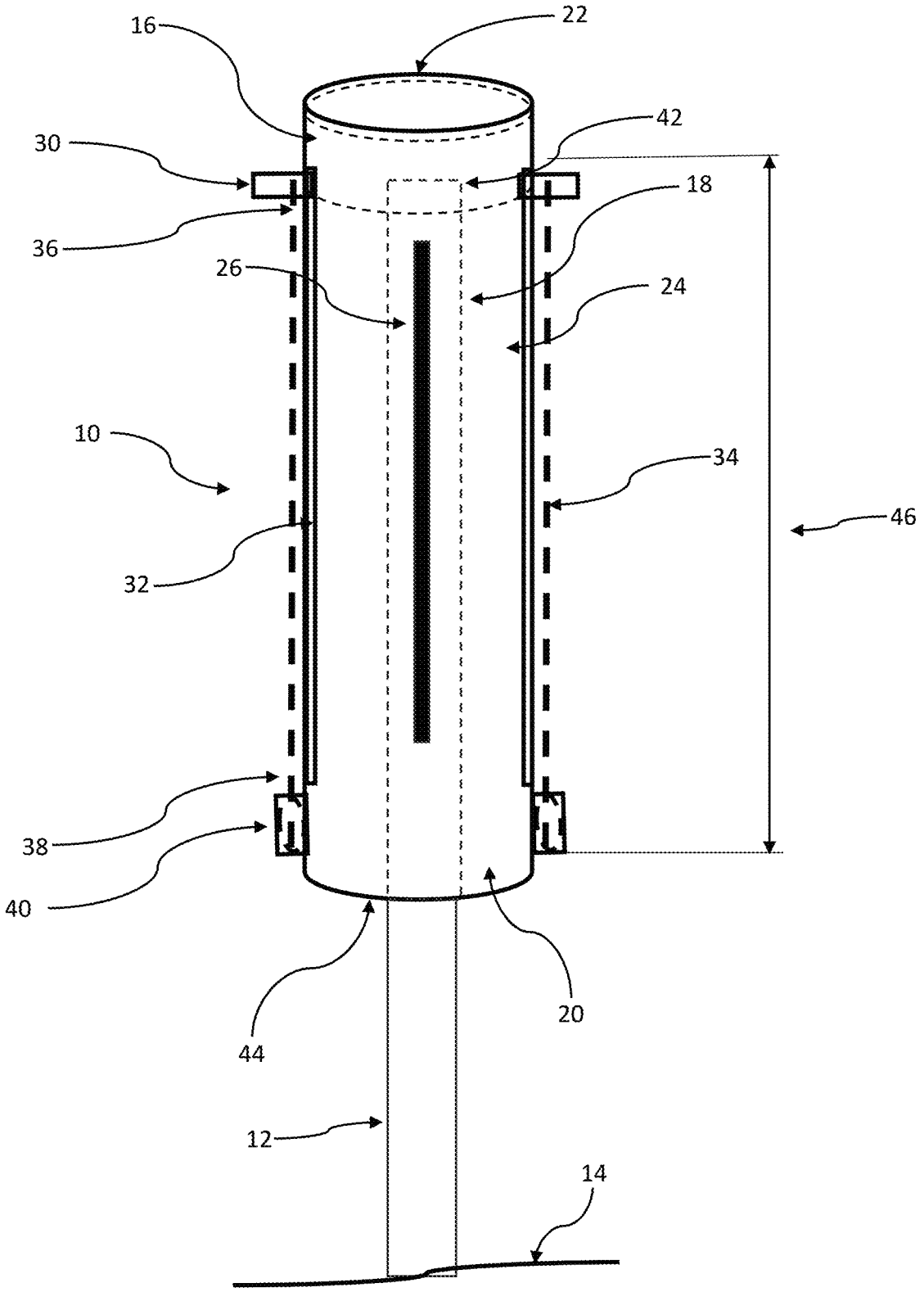
FIG. 4 is a view similar to FIG. 3 of the lowered post driver showing the lugs extending the springs.

Post driver 10 further includes a pair of springs 34 coupled to an outside of open lower end 20 of post receptacle 16 on opposite sides of post receptacle 16 and lugs 30 to assist in raising post driver 10. Springs 34 are preferably constant force springs, such as spiral springs. An example of a spiral spring is a clock spring, flat wire coil spring, tape measurer spring, etc. Each spiral spring 34 is preferably a flat metal strip wound about itself. When wound, a spiral spring applies a substantially constant force against being wound. Similarly, when being unwound, a spiral spring applies a substantially constant force. As shown in FIG. 2, spring 34 has a first end 36 coupled to lug 30 and a second end 38 positioned in housing 40 and fixed relative to post receptacle 16.

As post driver 10 is driven down by the user and gravity, plug 28 contacts a top end 42 of post 12, pushing plug 28 and lugs 30 upward relative to post receptacle 16. As lugs 30 move relative to post receptacle 16, the portion of spring 34 inside housing 40 winds and the portion of spring 34 outside of housing 40 extends. During this winding, spring 34 applies a substantially constant downward force to lugs 30 and plug 28. Spring 34 applies a substantially constant upward force to post receptacle 16, opposite the force applied to post driver 10 by the user through handles 26 and the opposite the force of gravity.

As post driver 10 is raised by the user, plug 28 remains in contact with top end 42 of post 12, raising post receptacle 16 upward relative plug 28 and lugs 30 and post 12. As lugs 30 move relative to post receptacle 16, the portion of spring 34 inside housing 40 unwinds and the portion of spring 34 outside of housing 40 retracts. During this unwinding, spring 34 applies a substantially constant downward force to lugs 30 and plug 28 and spring 34. Spring 34 also applies a substantially constant upward force to post receptacle 16, in the same direction of force applied to post driver 10 by the user through handles 26 and in an opposite direction of the force of gravity. The upward force applied to post driver 10 makes raising post driver 10 easier for the user.

Lower open end 20 of cylindrical body 24 includes an aperture 44 sized to receive post 12. Plug 28 is positioned a first distance 46 from aperture 44 when springs 34 are substantially wound. Plug 28 is positioned a second distance 48 from aperture 44 when springs 34 are substantially unwound. Second distance 48 is substantially less than first distance 46. Plug 28 travels about three-quarters of the length of post receptacle 16. According to alternative embodiments, plug 28 may travel more or less than the length of post receptacle 16, such as one-quarter, one-half, two-thirds, seven-eights, etc.

Springs 34 apply a substantially constant upward force to post receptacle 16 and the components supported thereby (e.g. handles 26, etc.) to assist raising post receptacle 16, etc. against the force of gravity, making it easier to raise post receptable 16, etc. Similarly, springs 34 apply a substantially downward force to lugs 30, plug 28, and post 12. During raising, springs 34 retract and are wound less. As post receptacle 16 is lowered by the user and/or gravity, springs 34 are reset for the next time post receptacle 16, etc. is raised by a user. During lowering, springs 34 extend and are wound more.

According to one embodiment, the substantially constant force provided by springs 34 is about equal to the force of gravity applied to post receptacle 16 and the components supported thereby (e.g. handles 26, etc.). With a two-spring design, the substantially constant force of each spring 34 is about half of this force of gravity. With fewer or more springs, the substantially constant force of each spring will be greater or lesser, respectively. According to alternative embodiments, the substantially constant force provided by springs 34, may be greater or less than the force of gravity applied to post receptacle 16 and the components supported thereby (e.g. handles 26, etc.).

Figure 5:
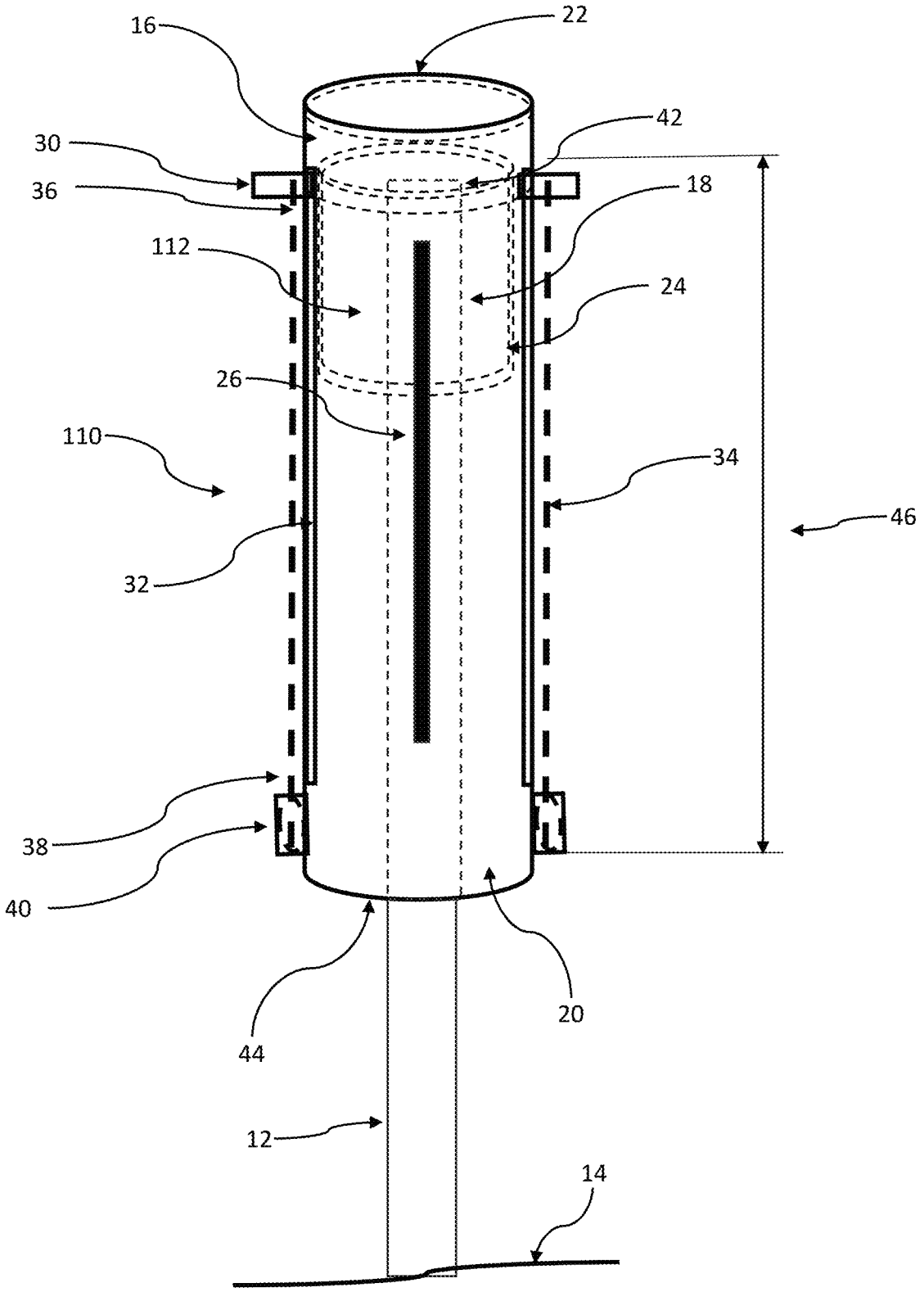
FIG. 5 is a side view of an alternate embodiment post driver further including a tube or shuttle sized to align the plug with the cylindrical body.
Figure 6:
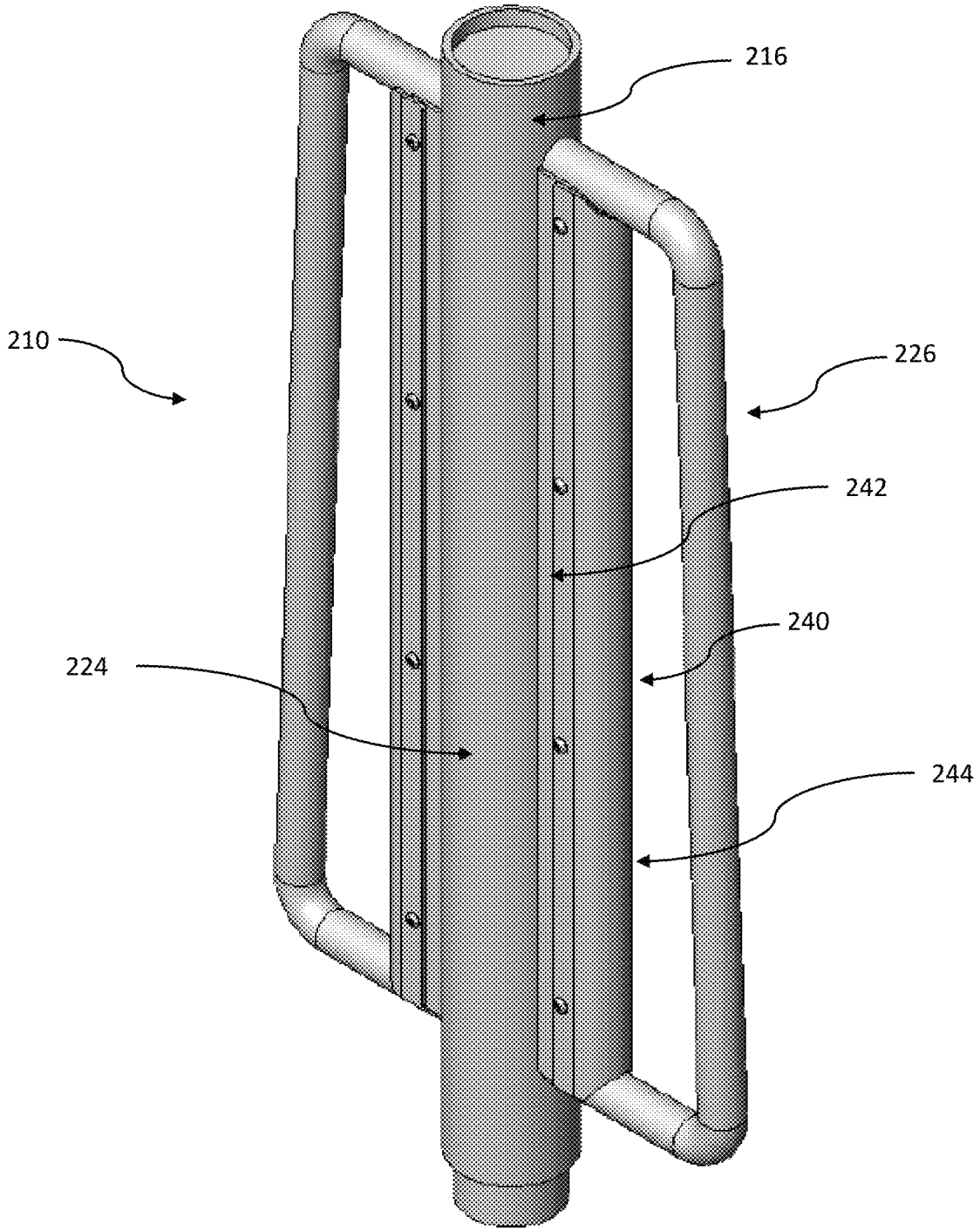
FIG. 6 is a perspective view of an alternative embodiment post driver.
Figure 7:
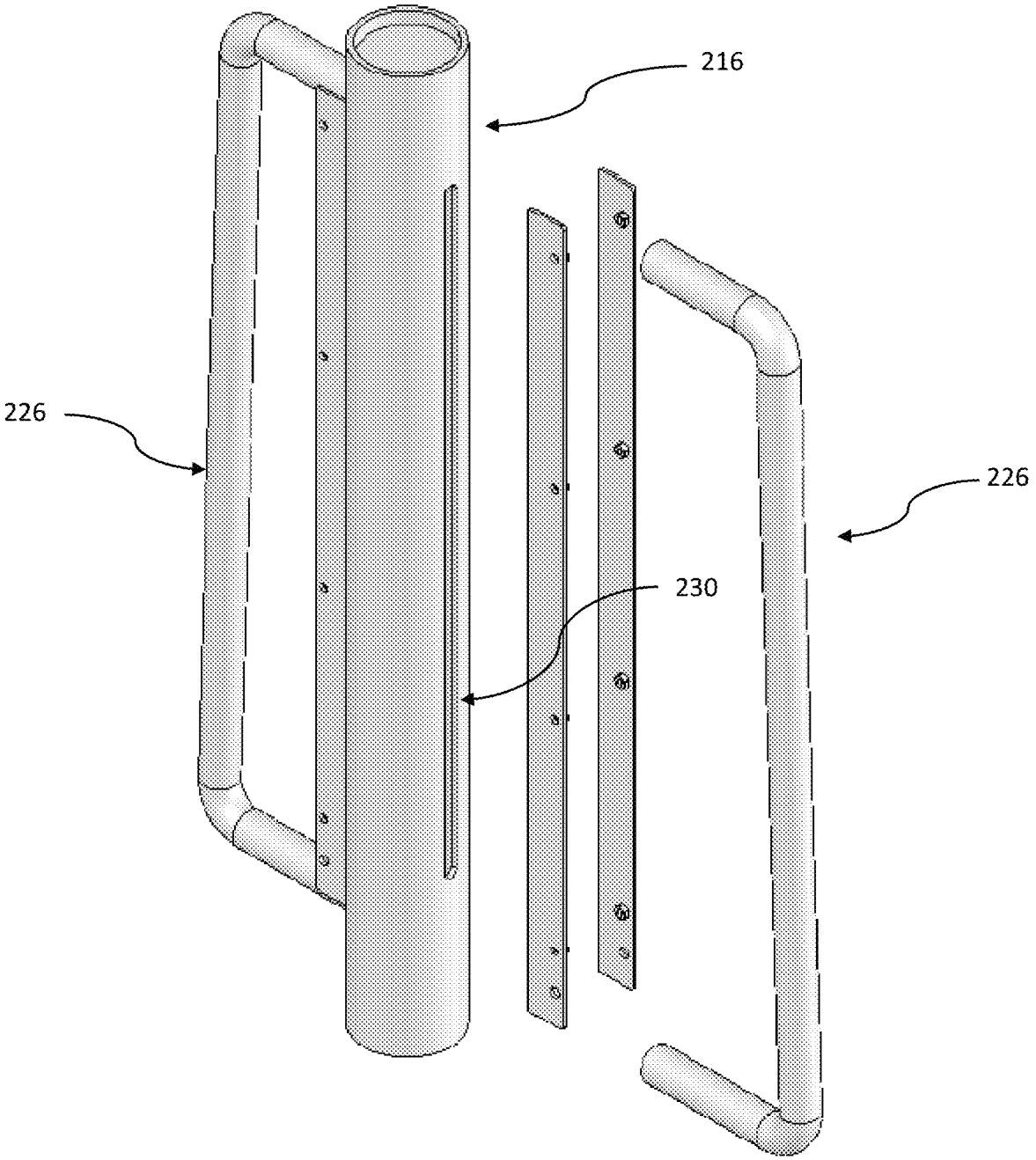
FIG. 7 is a partial assembly view of the post driver of FIG. 6

According to an alternative embodiment shown in FIG. 5, post driver 110 includes a shuttle or tube 112 positioned in interior 18 of post receptacle 16 and coupled to plug 28. Tube 112 assists in aligning plug 28 relative to post receptacle during movement relative thereto. This post driver 110 and the other post drivers 210, etc. described herein operate in the same as or similar manner as post driver 10.

Another alternative embodiment post driver 210 is shown in FIGS. 6-9. Post driver 210 includes a post receptacle 216 having an interior sized to receive post 12. Post driver 210 includes cylindrical body 224 and a pair of handles 226 coupled to cylindrical body 224. Post driver 210 also includes a plug 228 and alignment tube 212 positioned in cylindrical body 224. Post driver 220 also includes a bolt or bar 229 defining a pair of lugs 230 extending through alignment tube 212 and plug 228. Cylindrical body 224 of post receptacle 216 includes a pair of slots 232. Lugs 230 are positioned in respective slots 232.

Figure 8:
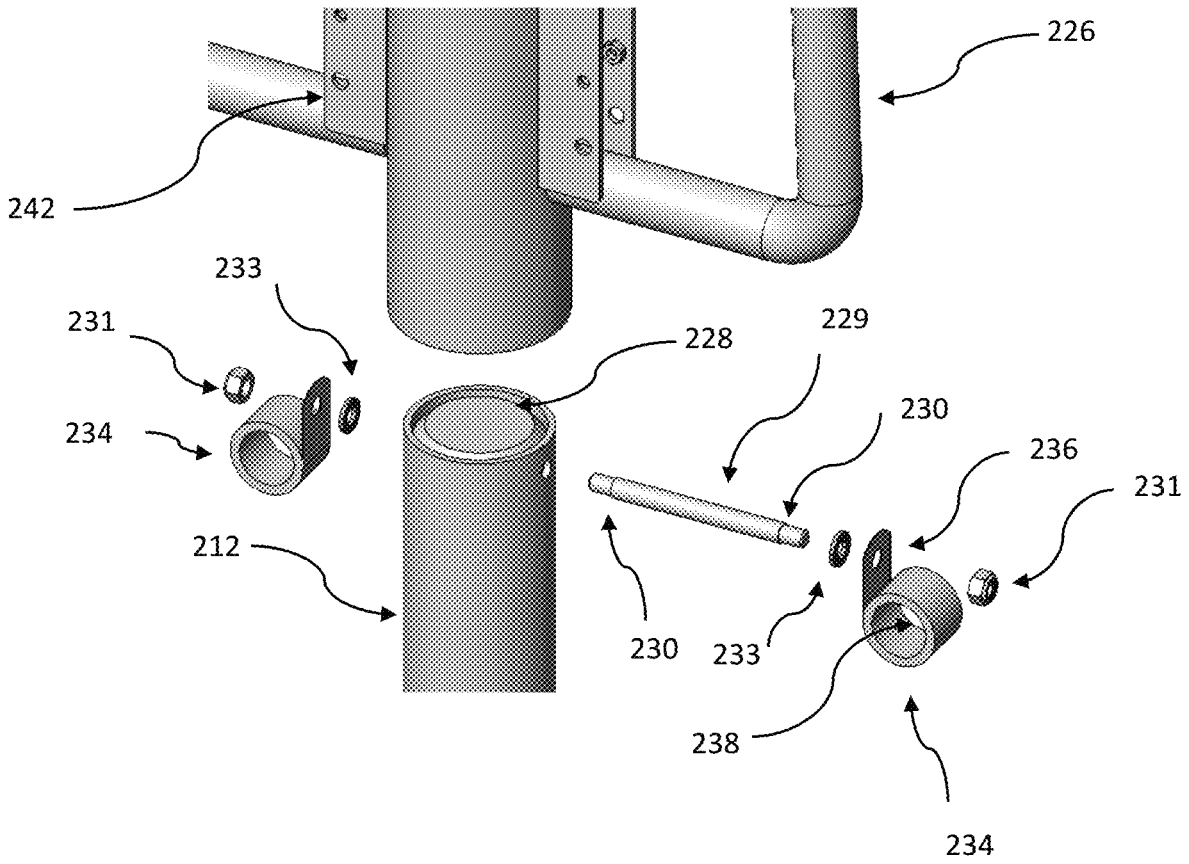
FIG. 8 is another partial assembly view of the post driver of FIG. 6.
Figure 9:
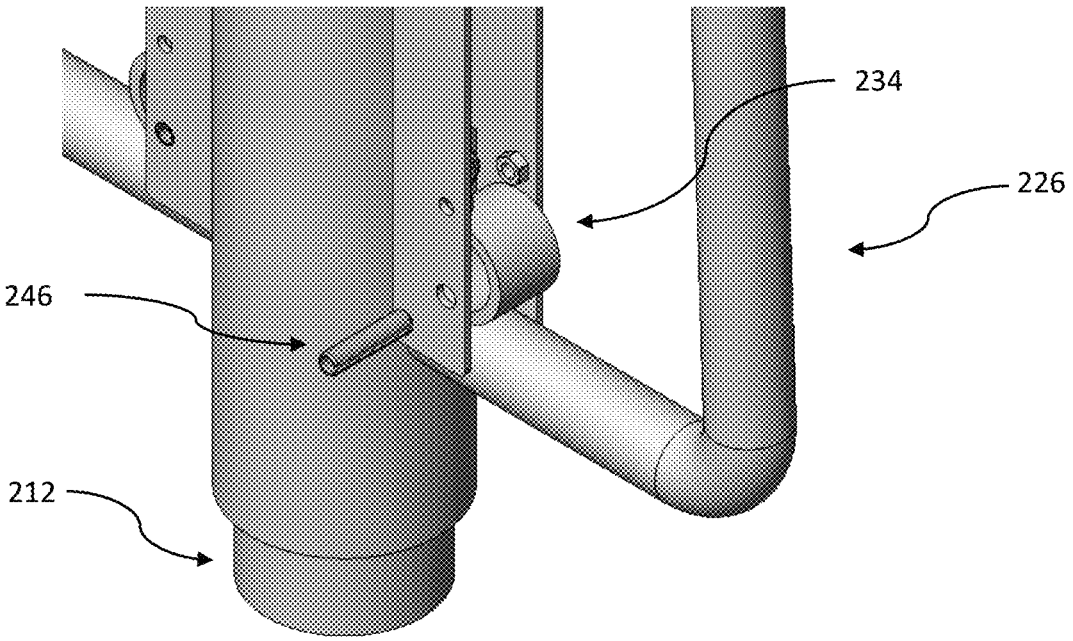
FIG. 9 is another partial assembly view of the post driver of FIG. 6

Post driver 210 further includes a pair of springs 234 coupled to an outside of post receptacle 216 on opposite sides of post receptacle 216 and lugs 230 to assist in raising post driver 210. Springs 234 are preferably constant force springs, such as spiral springs. As shown in FIG. 8, springs 234 have a first end 236 coupled to lugs 230 with nuts 231 and second ends 238 positioned in housings 240 and fixed relative to post receptacle 216 from raising and lowering. Washers 233 may be provided. Each housing 240 includes a pair of plates 242 positioned adjacent to slots 232 and a cover 244 coupled to plates 242. Spring pins 246 couple second ends 238 of springs 234 to housings 240. During extension and retraction, second ends 238 of springs 234 may rotate around spring pins 246.

What is claimed is:

1. A post driver including a post receptacle having an interior sized to receive a post, at least one handle supported by the post receptacle, a plug positioned in the post receptacle to drive a post received by the post receptacle, and at least one substantially constant force spring coupled to the plug to apply a substantially constant force to the plug.

2. The post driver of claim 1, wherein the at least one spring is a spiral spring.

3. The post driver of claim 1, wherein the post receptacle includes an aperture sized to receive the post, the plug is positioned a first distance from the aperture when the spiral spring is substantially wound, and the plug is positioned a second distance from the aperture when the spiral spring is substantially unwound, the second distance being substantially less than the first distance.

4. The post driver of claim 1, further comprising at least one lug coupled to the plug and the at least one substantially constant force spring, wherein the post receptacle has at least one slot and the at least one lug is positioned in the at least one slot.

5. The post driver of claim 1, wherein the at least one substantially constant force spring includes a first substantially constant force spring and a second substantially constant force spring positioned opposite the first substantially constant force spring relative to the post receptacle.

6. The post driver of claim 1, wherein the post receptacle includes a first end, a second end opposite the first end, and an aperture sized to receive the post, the aperture being positioned on the second end of the post receptacle, and the at least one substantially constant force spring being positioned on the first end of the post receptacle.

7. A post driver including a post receptacle having an interior sized to receive a receive a post, at least one handle supported by the post receptacle, a plug positioned in the post receptacle to drive a post received by the post receptacle, and at least one spring coupled between the post receptacle and plug to apply a force to the plug, the at least one spring being positioned outside of the interior of the post receptacle.

8. The post driver of claim 7, further comprising at least one lug coupled to the plug and spring, wherein the post receptacle has at least one slot and the at least one lug is positioned in the at least one slot.

9. The post driver of claim 7, wherein the at least one spring is a substantially constant force spring.

10. The post driver of claim 7, wherein the at least one spring includes a first spring and a second spring positioned opposite the first substantially constant force spring relative to the post receptacle.

11. The post hole driver of claim 7, wherein the post driver includes a top-most end and bottom-most end configured to receive the post and the at least one spring extends below the plug.

12. The post hole driver of claim 7, wherein post receptacle has the longitudinal axis and an outer surface spaced apart the longitudinal axis by a first lateral distance and the at least one spring is spaced apart from the longitudinal axis by a second lateral distance that is greater the first lateral distance.

13. A method of driving a post providing a post driver and a post, driving the post with the post driver into the ground, and applying a substantially constant upward force to the post driver as the post driver is raised relative to the post.

14. The method of claim 13, wherein the post driver includes a post receptacle having an interior receiving the post and a plug positioned in the post receptacle to drive the post, the driving step including the steps of applying force to the post receptacle to move the post receptacle toward the ground and striking the post with the plug, a user and gravity applying a first force to the post receptacle during the force applying step in a first direction, and the plug applying a second force to the post receptacle in a second direction during the force applying step, the second direction is opposite the first direction.

15. The method of claim 13, wherein the post driver includes a spring applying the substantially constant upward force to the post driver.

* * * * *